United States Patent [19]

Nilsson

[11] 3,999,469

[45] Dec. 28, 1976

[54] BASE FOLDING-IN ARRANGEMENT IN A PACKAGING MACHINE

[75] Inventor: Jan-Osten Nilsson, Malmo, Sweden

[73] Assignee: AB Ziristor, Lund, Sweden

[22] Filed: Aug. 11, 1975

[21] Appl. No.: 603,459

[30] Foreign Application Priority Data

Aug. 21, 1974 Sweden ..... 7410609

[52] U.S. Cl. ..... 93/36.8; 93/44.1 R

[51] Int. Cl.[2] ..... B31B 1/52

[58] Field of Search ..... 93/36.8, 39.1 R, 39.1 P, 93/39.2, 44.1 R, 44.1 GT, 49 R; 53/374, 375, 376

[56] References Cited

UNITED STATES PATENTS

| | | | |
|---|---|---|---|
| 3,207,049 | 9/1965 | Monroe et al. | 93/44.1 R |
| 3,789,746 | 2/1974 | Martensson et al. | 93/39.2 |

*Primary Examiner*—James F. Coan

*Attorney, Agent, or Firm*—Pierce, Scheffler & Parker

[57] ABSTRACT

A packaging machine of the invention includes a base folding-in arrangement comprising a first device carrying out a linear reciprocating motion and folding down one of the main base panels, and a second folding-in device which folds down the second main base panel partly overlying the first-named base panel.

5 Claims, 2 Drawing Figures

BASE FOLDING-IN ARRANGEMENT IN A PACKAGING MACHINE

Figure 1:
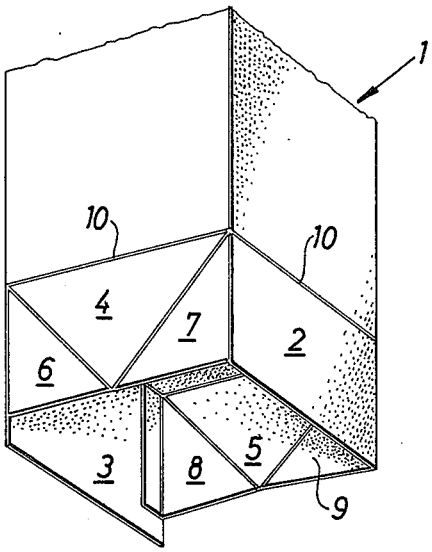

The present invention relates to an arrangement in a packaging machine of the type which, by means of working operations at a number of stations arranged in sequence, produces filled packages from prefabricated tubular blanks provided with crease lines, which blanks at their base ends comprise a number of panels separated by means of crease lines, namely two main base panels situated at opposite sides of the blank and a number of preferably triangular panels situated between these, which arrangement is intended to form the base of the tubular blank by means of folding down of the two main base panels against and partly over one another with simultaneous folding-in of the triangular panels underneath the main base panels.

Packaging machines of the above-mentioned type are used for the manufacture of filled and closed packages from previously made blanks, provided with crease lines to facilitate the formation of folds, of a material coated with thermoplastics, e.g. cardboard coated with plastics. The blanks are fed through the machine past a number of processing stations and are successively converted to filled, closed packages. The number of processing stations is arranged in a circle around a peg wheel, on whose pegs the package blanks are placed with the future top end pointing towards the centre of the peg wheel. As the peg wheel is rotated in steps, each package blank in turn and sequence is passed to the stations for warming up of the base end, folding-in of the base panels and pressing down and sealing of the base panels. Subsequently the package blank, now provided with a base, is transferred to a horizontally movable conveyor which transports the blank to stations for the prefolding of the top end, filling of the package and closure of the top end.

In packaging machines of the above-mentioned type, a number of different base folding-in arrangements can be used. The simplest design of a base folding-in arrangement comprises two guide rails which are arranged on either side of the feed path of the package blank and which approach each other in the feed direction of the package blank, so that, when a package blank turned upwards and downwards passes between the guide rails, the main base panels of the blank are forced in direction towards one another. This base folding-in arrangement pre-supposes that the main base panels are oriented in the feed plane of the package blank, and thus makes certain demands on the orientation of the package blank on the peg wheel. These demands cannot always be met, since the orientation of the package blank is determined by a series of other factors, such as the orientation of the peg wheel in relation to the conveyor and the main top panel, and consequently it is often impossible to use a base folding-in arrangement with guide rails.

Another base folding-in arrangement is known which is designed to be used in such packaging machines, in which the package blanks placed on the peg wheel are oriented so, that the main base lugs extend at an angle to the path of motion of the package blanks. This base folder comprises a first and a second folding arm arranged so that they can swivel, which folding arms are both pivoted in a common foundation fixed in the machine and are joined together by means of a link, which transmits the movement of the first swivelling arm to the second swivelling arm. This base folding-in arrangement operates in the following manner. When the front main base lug, seen in the feed direction of the package blank, approaches the folding arms of the base folding-in arrangement, these arms are in such a position, that the main base lug passes freely underneath the first folding arm so as to collide with the second folding arm. As the package blank continues to move, the main base lug and the second folding arm will mutually affect one another. At the same time as the second folding arm commences the folding down of the front main base panel of the package, the latter will drive the folding arm in the direction of movement of the package blank. Through this driving away of the second folding arm, the first folding arm will, via the link joining the folding arms together, move with great speed in the direction of the package blank and in a sudden manner fold down the second main base panel of the package blank. This base folding-in arrangement was found to be subject to certain disadvantages, thus e.g. the great speed of the first folding arm easily leads to the main base panels being damaged.

Another known base folding-in arrangement comprises a closing element which is movable between a rest position and a working position. The direction of movement of the closing element coincides substantially with the longitudinal axis of the package blank, and the closing element is arranged directly above the base part of the blank. The closure takes place in that two guiding surfaces for the main base panels, arranged with a certain mutual orientation, act upon the same during the working stroke of the closing element. The guiding surfaces are arranged so that the base lugs are folded down in a certain sequence. However, this base folding-in arrangement too is subject to certain disadvantages and has, inter alia, certain tendencies towards buckling of especially the longer main base panel. Similarly to the base folding-in arrangements described earlier, this arrangement requires a "breaking open" of the crease lines of the base panels, which breaking open may take place either at an earlier station or directly before the folding down of the main base panel.

It is the object of the present invention to eliminate the aforementioned disadvantages and to provide a simple base folding-in arrangement with a low tendency towards buckling and misfolding, together with high operational safety.

These objects have been achieved in accordance with the invention through that a base folding-in arrangement of the type described in the beginning is characterized, in that it comprises on the one hand a first folding-in device which can carry out a linear reciprocating motion and is arranged to fold down one of the main base panels, on the other hand a second folding-in device which is pivoted and folds down the second main base panel partly over the firstnamed main base panel.

Preferred embodiments of this arrangement were given the characteristics which are evident from the subsidiary claims.

The invention will be described in detail in the following with reference to the enclosed drawings.

Figure 2:
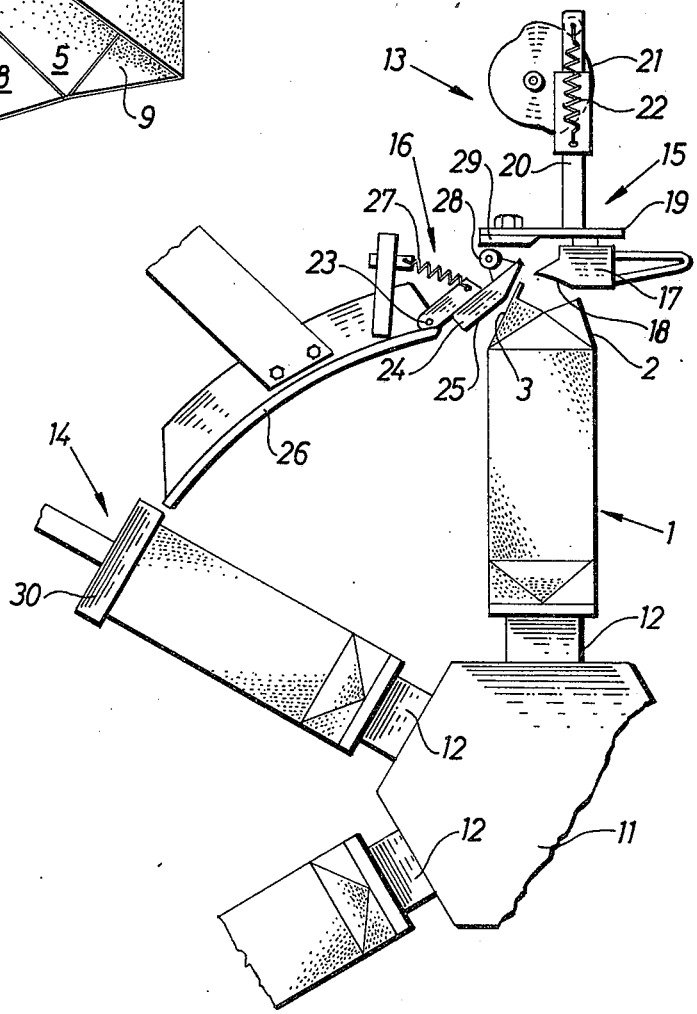

FIG. 1 shows the bottom part of a typical blank for use together with the base folding-in arrangement according to the invention, and FIG. 2 shows schematically a part of a packaging machine with peg wheel and base folding-in station.

In FIG. 1 is shown the bottom end of a tubular package blank of the type for which the base folding-in arrangement in accordance with the invention is specially intended. The figure illustrates that the base part of the blank 1 comprises two large rectangular main base panels 2,3 and two smaller triangular base panels 4,5 which are joined to the main base panels via backfolding panels 6–9. All the said panels are delimited against one another and against the container body proper by means of crease lines arranged in the packing material so as to facilitate the folding.

To make possible during the formation of the base the folding down of the main panels 2,3 against one another with simultaneous folding in of the triangular base panels 4,5 and of the backfolding panels 6–9 under the main base panels, a breaking open is required of the crease lines which facilitate and guide the folding before the actual folding-in. This pre-folding takes place in that the triangular base panels 4,5 are partly folded down against one another, as a result of which the other base panels are also mutually displaced and the crease lines delimiting the base panels are broken open. Owing to the elasticity of the material, the base panels largely return to the position they had before the pre-folding operation.

The package blanks may consist of laminated material, for example paper coated with a thermoplastic material (e.g. polyethene), the thermoplastic layer being utilized on the one hand for making the packages impervious to liquids, and on the other hand to make possible a sealing of the packages by means of heat and pressure.

FIG. 2 shows part of a packaging machine of the type for which the base-folding-in arrangement in accordance with the invention is intended. The packaging machine comprises a peg wheel 11 on the pegs 12 of which are placed the package blanks 1, the top ends being directed towards the centre of the peg wheel 11. A number of processing stations are arranged around the peg wheel, i.e. in turn and sequence, a station for the placing of a package blank onto a peg, a station for the heating of the base end, a station for the folding-in of the panels of the base end, and finally a station for the pulling of the package blank provided with base off the peg. On the drawing are shown only the base folding-in station which is given the general designation 13, and a station for the pressing down and sealing of the base designated 14.

The base folding-in station 13 comprises a first folding-in device 15 and a second folding-in device 16. The folding-in device 15 has at its front end facing towards the base part of the package blank a jaw 17 with a concave guiding or folding surface 18. The jaw 17 is attached to the underside of a plate 19, which in turn is supported by a vertical, displaceable bar 20, which at its upper end co-operates with a cam disk 21. A spring 22 endeavours to displace the bar 20 in the direction towards the package blank. The second folding-in device 16 comprises a jaw which can pivot about an axle 23 and which on the underside is provided with a substantially plane guiding surface 25 which is bevelled at the end remote from the axle 23. The jaw 24 is supported via the axle 23 by a guiding rail 26 which is rigidly fixed in the framework of the packaging machine. An adjustable tension spring 27 is arranged to act upon the jaw 24 in the direction against the upper or rest position of the same shown on the drawing. The jaw 24 is provided on its upper side with a pulley 28, which is arranged so as to co-operate with a cam element 29 arranged adjustably on the attachment plate 19 of the first folding-in device 15.

The base pressing-down or sealing station 14 comprises a coolable pressure jaw 30, which is movable in the longitudinal direction of the blank present in the sealing station 14, and is actuated e.g. by means of a piston and cylinder unit (not shown).

In the following we will describe the working of the base folding-in arrangement in accordance with the invention. To simplify the description we will describe only the progress of one package blank 1 through the machine, whereas in reality naturally a large number of package blanks are transported simultaneously through the machine and are processed at different stations. When the package blank 1 has been placed on a peg 12, the peg wheel 11 is rotated one step, whereby the package blank 1 stops at the level of a base warming arrangement known in itself (not shown), which, as a preparation for the sealing, warms the base end of the package blank 1. After the heating the peg wheel 11 is again rotated one step, as a result of which the package blank 1 lands at the base folding-in station 13, whose different elements on this occasion are in the position shown on the drawing. When the package blank 1 is in the correct position, in the first place, as described previously, a folding-in or breaking-open of the crease lines delimiting the end panels 2–9 of the package blank takes place. This breaking open takes place by means of two elements, not shown on the drawing, which during a short instant partly fold down the panels 4 of the end part in the direction towards one another. During this operation the cam disk 21 is in the position shown on the drawing, but immediately on completion of the pre-folding the cam disk 21 has turned into such a position, that the spring 22 can freely displace the folding jaw 17 in the direction towards the package blank 1. When this happens, the guiding surface 18 comes into contact with the main base panel 2 of the package blank 1 and initiates a folding down of the same. At the same time the cam element 29, attached to the fixing plate 19, will act upon the pulley 28, arranged at the upper side of the other folding jaw 24, as a result of which the jaw 24, against the action of the spring 27, will be swivelled downwards about the axle 23 and fold down the main base panel 3 of the package blank on the top of the main base panel 2, folded down immediately previously. During this folding down of the main base panels 2,3, the triangular end panels 4–9 are folded in automatically, owing to the earlier pre-folding, underneath the main base panels. By means of an adjustment of the position of the cam element 29 it is possible to regulate the distance along which the first folding-in device 15 moves before it drives the second folding-in device 16.

When both folding-in devices 15,16 have attained the bottom position, the work of the base folding-in station is finished, and the peg wheel 11 is induced to rotate a step further. When this happens the finished folded base will slide off the guiding surface 25 of the jaw 24 and over to the bottom surface of the guiding rail 26. The guiding rail 26 extends as far as the pressure jaw 30 of the subsequent sealing station 14, so that the base part of the package blank 1 can readily slide in underneath the pressure jaw 30 when the latter is in its upper position, as shown on the drawing. In this station 14, in a known manner, a pressing down and sealing of the base takes place with the help of the pressure jaw 30, which, simultaneously with the pressing down of the base, cools the heated thermoplastic material and induces the base panels to stick together so as to form a tight and plane base.

Since the axle 23, about which the folding-in device 16 swivels out of the working position, is parallel with the crease line 10, about which swivels the main base lug 3 during folding-in, the movements of the folding jaw 24 and of the main base lug 3 will be substantially uniform, which implies that the risk of buckling or misfolding is substantially reduced. Altogether, the base folding-in arrangement in accordance with the invention presents particularly good operational safety and, moreover, eliminates the disadvantages which affect previous base folding-in arrangements.

I claim:

1. In a machine for forming packages from a preformed tubular member of packaging material at a series of succeeding stations, said tubular member having two opposed outer bottom-forming panels, each provided with a crease line where it adjoins the adjacent side of the package and opposed inner bottom-forming panels intermediate said outer panels and provided with crease lines defining triangular panels which are folded inwardly when said outer panels are folded down to form the bottom of the package, the improvement comprising, at the bottom-forming station, a first means reciprocally movable along the axis of and toward and away from the tubular member for folding down one of the opposed outer panels, means for reciprocally moving said first means, a second means pivotally mounted at a fixed point for folding down the other of the opposed outer panels, means mounted on said first reciprocally movable means for pivoting said second pivotally mounted means, whereby the one of the opposed outer panels underlies the other of the opposed outer panels and fixed means for retaining both of the outer panels in their folded down position as the package is moved to a succeeding station.

2. In a machine as claimed in claim 1 the improvement wherein said first reciprocally movable means is provided with a concave cylindrical surface for engaging the outer edge of the one of the opposed outer panels when moving toward the tubular member and wherein the axis of pivoting of said second pivotally mounted means is parallel to the outer edge of the other of the opposed outer panels whereby the outer panels are uniformly folded along their crease lines during the folding down of said outer panels.

3. In a machine as claimed in claim 1 the improvement wherein said second means is pivotally mounted on the fixed means for retaining both of the outer panels in their folded down position.

4. In a machine as claimed in claim 1 the improvement wherein said second means, when in its normal disengaged rest position, is spaced from said means mounted on said first means for pivoting said second means, whereby said second means is pivoted to fold the other of the opposed outer panels after said first means has started its reciprocal movement toward the tubular member for folding the one of the opposed outer panels.

5. In a machine as claimed in claim 1 the improvement further comprising a spring member normally biasing said second means in its normal disengaged rest position.

* * * * *